United States Patent [19]

Biemans

[11] Patent Number: 4,492,325

[45] Date of Patent: Jan. 8, 1985

[54] NEEDLE THREADING DEVICE

[76] Inventor: Arnoldus Biemans, Mathenesserlaan 432, 3023 Hg Rotterdam, Netherlands

[21] Appl. No.: 396,022

[22] Filed: Jul. 7, 1982

[51] Int. Cl.[3] ..... D05B 87/02

[52] U.S. Cl. ..... 223/99

[58] Field of Search ..... 223/99; 112/225; 29/241

[56] References Cited

U.S. PATENT DOCUMENTS

| | | | |
|---|---|---|---|
| 2,338,159 | 1/1944 | Appleton | 223/99 |
| 2,641,394 | 6/1953 | Cotter | 223/99 |
| 2,679,959 | 6/1954 | Von Ullisperger et al. | 223/99 |
| 3,000,545 | 9/1961 | Ullisperger | 223/99 |

FOREIGN PATENT DOCUMENTS

| | | | |
|---|---|---|---|
| 494383 | 3/1950 | Belgium | 223/99 |
| 1048724 | 8/1953 | France | 223/99 |
| 1066463 | 1/1954 | France | 223/99 |
| 1108740 | 9/1955 | France | 223/99 |
| 488887 | 1/1954 | Italy . | |
| 1465696 | 12/1977 | United Kingdom | 223/99 |

*Primary Examiner*—Robert R. Mackey

*Attorney, Agent, or Firm*—Body, Vickers & Daniels

[57] ABSTRACT

An improved manually operable needle threading device is provided of the character including a housing having an upwardly extending tubular needle receiving support and a displaceable needle threader member in the housing for displacing a thread through openings in the needle support and the eye of a needle therein. The improvements include a slot extending upwardly through the needle support from one of the openings therein to facilitate removal of the threaded needle when one end of the thread is fixed against movement, and an improved actuating arrangement for displacing the needle threader member relative to the needle support.

7 Claims, 6 Drawing Figures

FIG. 1
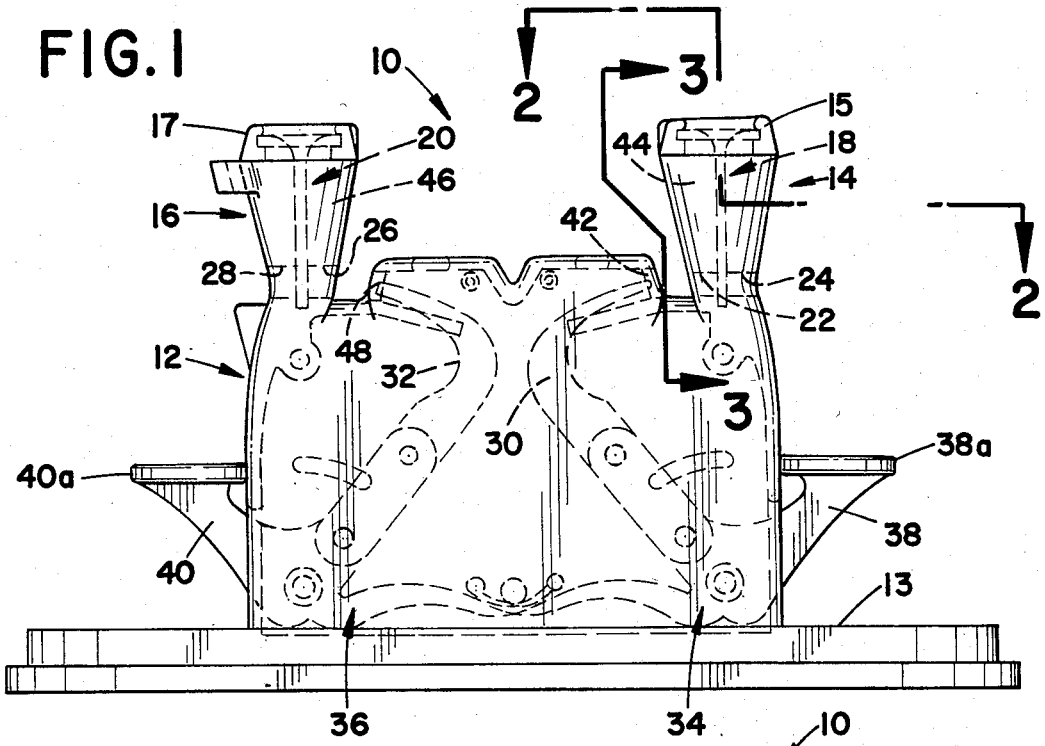
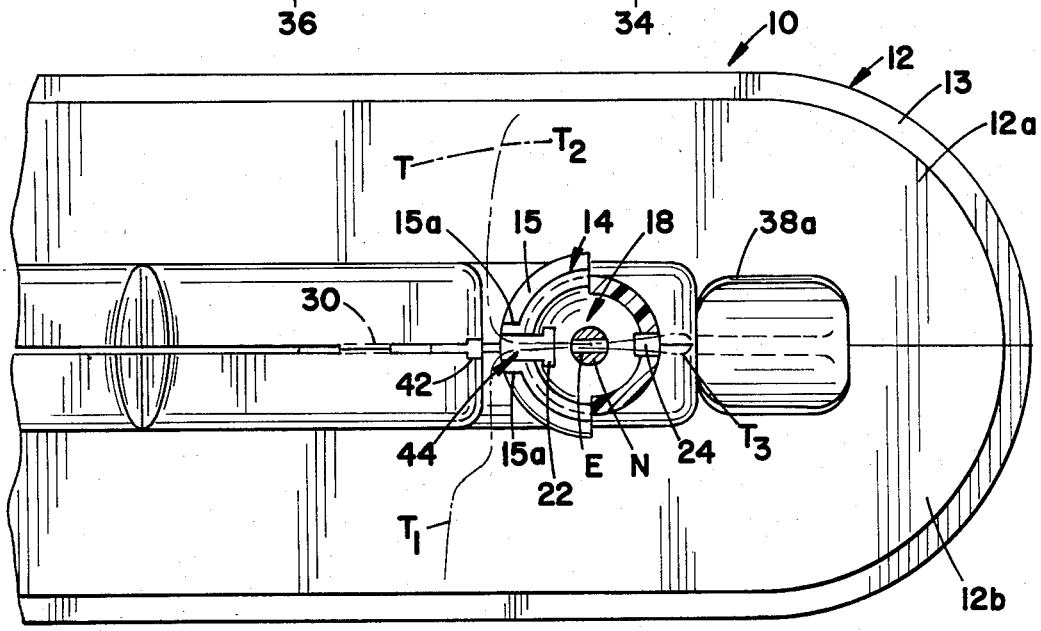
FIG. 2
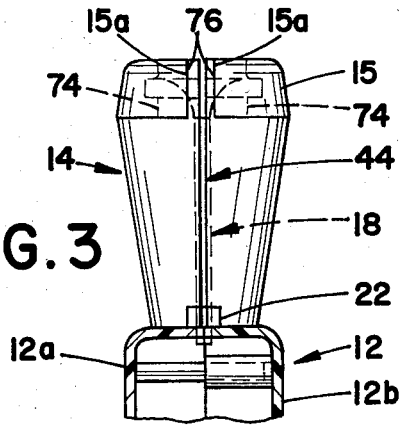
FIG. 3

NEEDLE THREADING DEVICE

BACKGROUND OF THE INVENTION

This invention relates to improvements in needle threading devices of the type having a needle threader member manually operable to displace a thread through the eye of a needle supported in the device.

Manually operable threading devices of the type to which the present invention relates are known, as shown for example in U.S. Pat. No. 2,679,959 to Von Ullisperger et al and Italian patent No. 488,887. Such devices include a housing, a needle support including an upwardly open cavity to receive and support the eye end of a needle, openings through the support transverse to the cavity and aligned with the eye of a needle therein, and a needle threader member supported in the housing for displacement through the openings and the needle eye to displace a thread through the needle eye, whereby the needle becomes threaded. In the Von Ullisperger et al device, the needle threader is pivotal relative to the housing and is displaced by a vertically reciprocable, spring biased camming plunger engaging a cam follower roller mounted on a lever supporting the needle threader member. In the Italian patent, the needle threader is horizontally reciprocable relative to the housing and has an outer end adjacent the housing to achieve such reciprocation.

In both of the needle threading devices referred to above, the needle threading operation requires breaking off a length of thread, displacing a portion of the thread between the ends thereof through the needle eye by actuation of the needle threader member, and displacing the needle and the length of thread in its entirety upwardly through the needle cavity by passage of the thread ends through the openings in the needle support and into the cavity. It is not possible, with these prior art arrangements, to separate the needle threader from a thread having one end essentially fixed against displacement through the openings in the needle support upon withdrawal of the threaded needle therefrom. For example, if a person is sewing a piece of material and accidentally displaces the needle from threaded engagement with the free end thereof, it is not possible to rethread the needle and thereafter achieve separation of the needle threader from the thread. In this respect, it will be appreciated that the end of the thread attached to the material being sewed is fixed with respect to the material, and the latter prevents displacement of the thread through the openings in the needle support upon removal of the threaded needle therefrom. Such accidental unthreading of a needle during sewing is a common occurrence and, in addition to the inconvenience of rethreading the needle by hand, such rethreading may be extremely difficult and perhaps even an impossible task for a person having poor eyesight and/or the inability to hold the needle and thread steady to achieve insertion of the thread through the needle eye.

Manually operable needle threaders of the character to which the present invention relates have enjoyed limited saleability heretofore, partially as a result of the foregoing limitations and inconvenience with respect to use thereof and partially because the cost of manufacture thereof has precluded an acceptable price in the market place. More particularly in this respect, the devices are relatively small and heretofore have required the assembly of a considerable number of individual component parts which are individually expensive to produce. In particular, the mechanisms heretofore provided for supporting and displacing the needle threader member have been structurally complex and unduly expensive in this respect. Moreover, hand assembly of all of the component parts is required, and the number and small size thereof makes such hand assembly a difficult and tedious endeavor requiring considerable time, thus undesirably adding to the expense of manufacture.

SUMMARY OF THE INVENTION

In accordance with the present invention, an improved manually operable needle threading device is provided which, in accordance with one aspect of the invention, advantageously enables separation of a threaded needle therefrom regardless of whether or not one end of the thread is fixed such as to a piece of material being sewed. More particularly in accordance with this aspect of the invention, the side of the needle support having the opening through which the needle threader member first moves in connection with a needle threading operation is provided with a thread passageway between the opening and the upper end of the needle support, which passageway provides an exit path for the thread following the threading operation. Therefore, following the displacement of the free end of a thread through a needle eye in a needle threading operation, the portion of the thread between the needle eye and the opposite end of the thread is displaceable through the passageway, thus freeing the thread from the threading device. Accordingly, it will be appreciated that if such opposite end of the thread is fixed such as to material being sewed, and the needle is accidentally displaced from the free end of a thread during the sewing of the material, the needle can be rethreaded on the free end and the thread between the needle and material can be separated from the device so as to enable continued sewing.

In accordance with another aspect of the invention, the actuator for the needle threader member is a one-piece component including a pivotal lever supporting the threader member, an arm extending outside the housing to facilitate pivoting the lever and thus displacing the threader member in the needle threading direction, and an integral biasing component by which the lever and threader member are biased back to an initial position after a needle threading operation. Preferably, the threader member is a thin sheet metal component loosely received on the lever of the actuator, and the actuator and needle threader member are supported and guided during operation of the device, and against separation, by component parts in the housing and without the permanent fastening of the needle threader member to the actuator. The housing is preferably comprised of two halves having interengaging projections and recesses to facilitate assembly thereof, and all that is necessary to achieve such assembly is the positioning of the threader member on the actuator, positioning of the actuator in one-half of the housing, and joining of the other housing half therewith. Accordingly, it will be appreciated that the needle threader is comprised of a minimum number of parts and that assembly thereof is more quickly achieved than heretofore possible, all of which lends to minimizing the cost of production while providing a device which is efficient in operation and use.

It is accordingly an outstanding object of the present invention to provide an improved manually operable needle threading device.

Another object is the provision of a needle threading device which enables the threading of a needle and separation of the threaded needle from the device regardless of whether or not one end of the thread is fixed such as to material being sewed.

Still another object is the provision of a manually operable needle threader which enables the rethreading of a a needle to achieve continued sewing with a thread from which the needle has become separated.

A further object is the provision of a manually operable needle threader which is comprised of a minimum number of component parts which are structured and structurally interrelated in a manner which minimizes component part casts and minimizes assembly time, and thus the cost of production while providing a device which is structurally sound and efficient in operation and use.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which:

FIG. 1 is a side elevation view of a needle threading device in accordance with the present invention;

FIG. 2 is an enlarged plan view, partially in section, of a needle support of the device as seen along line 2—2 in FIG. 1, and showing a needle in the needle support;

FIG. 3 is an enlarged elevation view of the needle support portion of the device, partially in section, as seen along line 3—3 in FIG. 1;

DESCRIPTION OF A PREFERRED EMBODIMENT

Figures 4, 5:
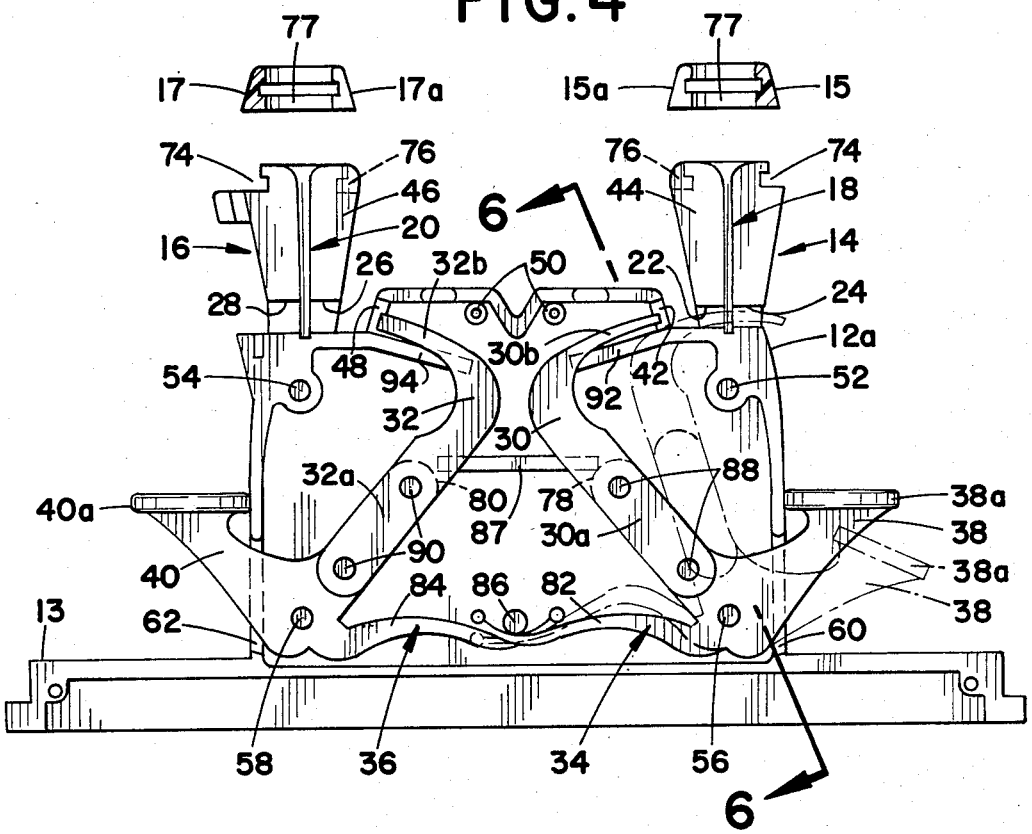
FIG. 4 is a side elevation view of one-half of the housing of the device and illustrating the threader member and actuator components in assembled relationship therewith.
FIG. 5 is a side elevation view of the other half of the housing.

With reference in greater detail to the drawings wherein the showings are for the purpose of illustrating a preferred embodiment of the invention only, and not for the purpose of limiting the invention, a needle threading device 10 is shown in FIGS. 1-3 which is comprised of a housing 12 of suitable material, such as plastic, and which includes a laterally extending base portion 13 by which the device is adapted to be supported on a table or the like. Housing 12 further includes upwardly extending needle supports 14 and 16 which are open at their upper ends and provided with vertically extending cavities 18 and 20, respectively, adapted to receive different sized needles to be threaded. As will be described in greater detail hereinafter, housing 12 in the preferred embodiment is comprised of housing halves **12*a* and 12*b* each including the corresponding halves of needle supports 14 and 16 and which latter halves are respectfully interengaged against lateral separation by means of resilient split rings 15 and 17 at the upper ends thereof. Each of the needle supports 14 and 16 is provided adjacent the bottom of the corresponding needle cavity with a pair of opposed openings transverse to the needle cavity, which openings for needle support 14 are designated by numerals 22 and 24 and for needle support 16 are designated by numerals 26 and 28. In a manner to be described in detail hereinafter, needle threader members 30 and 32 are independently supported in housing 12 by corresponding actuator levers 34 and 36 which are operable through displacement of lever arms 38 and 40, respectively, to displace the corresponding threader member relative to the corresponding needle support to achieve threading of a needle therein. More particularly, as will be appreciated from FIG. 2 with respect to threading a needle N in needle support 14 for example, the needle is introduced into cavity 18 with the eye end of the needle engaging the bottom of the cavity so that the needle eye E is in alignment with openings 22 and 24. A thread T having end portions T1 and T2 is then laid across the housing transverse to opening 22 and adjacent the outer end thereof. Lever 38 is then depressed by means of lever button 38*a*, whereby threader member 30 is displaced through an opening 42 provided therefor in housing 12 and against thread T. Thereafter, a portion T3 of the thread between ends T1 and T2 is displaced, sequentially, through opening 22, needle eye E and opening 24 to the position shown in FIG. 2. Threader member 30 is then displaced back into housing 12, and one of the thread ends, end T1 for example, is pulled through opening 24 by pulling a corresponding portion of the thread loop T3 outwardly adjacent opening 24. The threaded needle is then ready to be withdrawn from cavity 18**.

Heretofore, such withdrawal of the threaded needle required end T2 of thread T to be free to move through opening 22 in order to achieve separation of the thread from the threading device. In this respect, it will be appreciated that if end T2 was fixed such as by attachment to a piece of material, the material would prevent movement of thread end T2 through opening 22 and thus the thread end could not be separated from the threading device without breaking end T2 from its fixed disposition. According to one aspect of the present invention, as shown in FIGS. 2 and 3 with respect to needle support 14, this disadvantage is overcome by providing a thread passageway, preferably in the form of a slot 44, which extends laterally through the wall of the needle support between the upper end thereof and opening 22. Therefore, if thread end T2 is fixed such as to a piece of material being sewed, slot 44 provides a thread path which facilitates displacement of the portion of the thread between needle eye E and end T2 from the needle support upon withdrawal of the needle from cavity 18. Although slot 44 is illustrated as extending vertically and linearly from opening 22, it will be appreciated that the slot could be inclined or otherwise oriented relative to opening 22 and needle support 14, it only being necessary with this aspect of the invention that the slot or equivalent passageway provide a thread path enabling displacement of the thread between the needle eye and a fixed end of the thread out of opening 22 and upwardly through needle support 14 for separation of the thread from the threading device.

While FIGS. 2 and 3 illustrate slot 44 in connection with needle support 14, it will be appreciated that needle support 16 is provided with a similar slot 46 for the same purpose, and that housing 12 is provided with an opening 48 similar to opening 42 and which permits displacement of threader member 32 from within the housing to achieve a needle threading operation employing needle support 16. As will be apparent from the description hereinafter of the housing structure, the upper ends of the needle supports and the corresponding retaining rings interengage so as to preclude displacement of the retaining ring to a position covering the upper end of the corresponding slot.

In accordance with another aspect of the present invention, housing 12, actuator levers 34 and 36 and threader members 30 and 32 are structured and structurally interrelated in a manner which minimizes cost of production both by reducing costs of component parts and the time required to assemble the component parts. Further, the structures and structural interrelationships between these component parts provide for the threader members and the corresponding actuator levers to be interengaged without the use of a permanent fastening arrangement therebetween and to be supported and guided for displacement relative to the housing in a manner which maintains the corresponding threader members and actuator levers against separation from one another. More particularly in this respect, as will be seen from FIGS. 4–6 of the drawing, housing halves 12*a* and 12*b* are generally of identical mating configuration with respect to providing corresponding halves of base 13, needle supports 14 and 16, openings 22, 24, 26 and 28 in the needle supports, and openings 42 and 48 for the threader members. Housing halves 12*a* and 12*b* are adapted to be laterally interengaged by means of projections on the inner side of housing half 12*a* and apertured posts on the inner side of housing half 12*b* which provide recesses for the projections. In this respect, housing half 12*a* is provided with a pair of projections 50 adjacent the upper end of the housing half and intermediate the opposite ends thereof, projections 52 and 54 at the opposite ends of the housing half and beneath the corresponding one of the portions of needle supports 14 and 16, and projections 56 and 58 spaced beneath projections 52 and 54, respectively, and respectively adjacent an opening 60 for arm 38 of actuator lever 34 and an opening 62 for arm 40 of actuator lever 36. Housing half 12*b* is provided with apertured posts 64 providing recesses for projections 50, and apertured posts 66, 68, 70 and 72 providing recesses for projections 52, 54, 56 and 58, respectively.

It will be appreciated of course that when the housing halves are positioned in lateral alignment, the projections are received in the corresponding apertured posts, to laterally interengage the housing halves, which interengagement can be by a friction fit to retain the housing halves against unintended lateral separation. While the laterally adjacent portions of needle supports 14 and 16 could be interengaged by similar projection and recess arrangements, the size of the component parts makes the latter difficult, whereby the use of retaining rings 15 and 17 is preferred as described hereinabove. In connection with the use of retaining rings, the portions of needle supports 14 and 16 of each housing half are provided with a circumferential recess 74 which, as best seen in FIG. 3, terminates in a shoulder 76 slightly spaced from the corresponding surface of the needle support portion defining slot 44. Shoulders 76 are abutted by the corresponding ones of the opposite ends 15*a* and 17*a* of the retaining rings when the housing halves are assembled. Further, each of the retaining rings 15 and 17 is provided with a radially inwardly extending circumferential flange 77 engaging in the corresponding recesses 74 when the housing halves are assembled, whereby the retaining rings are held against unintentional displacement from the needle supports. The use of such retaining rings further facilitates providing a visual indication with respect to the use of needle supports 14 and 16 for different size needles, such as by providing for the retaining rings to be of different color.

Importantly in connection with the structural aspects of the present invention, actuator levers 34 and 36 are of identical one-piece construction, and each is adapted to support the corresponding one of the threader members 30 and 32 to provide for displacement of the latter during a needle threading operation, and to return the threader member into the housing following such threading of a needle. More particularly, actuator levers 34 and 36 are of generally inverted T-shaped configuration and, in addition to the respective actuating arms 38 and 40 include leg portions 78 and 80, respectively, and biasing arms 82 and 84, respectively. Actuator lever 34 is apertured adjacent the intersection of legs 78 and arms 38 and 82 to receive projection 56 on housing portion 12*a*, whereby the actuator lever is supported by projection 56 for pivotal movement relative to the housing. Actuator lever 36 is similarly apertured to be received on and pivotally supported by projection 58 on housing half 12*a*. Biasing arms 82 and 84 are sufficiently thin to be flexible and have corresponding inner ends, not designated numerically, engaged under a common projection 86 on housing half 12*a*. Accordingly, it will be appreciated that depression of the corresponding one of the actuating arm tabs 38*a* and 40*a* results in pivotal displacement of the actuator levers and the corresponding one of the threader members 30 and 32 from the solid line to the broken line positions thereof and against the bias of the corresponding one of the biasing arms 82 and 84, and that release of the tabs 38*a* and 40*a* returns the actuator levers to the solid line positions thereof by the biasing arms 82 and 84. Housing portion 12*a* is provided with a rib 87 having opposite ends adapted to be engaged by the lever arms to limit inward displacement of the actuator levers under the influence of biasing arms 82 and 84.

Figure 6:
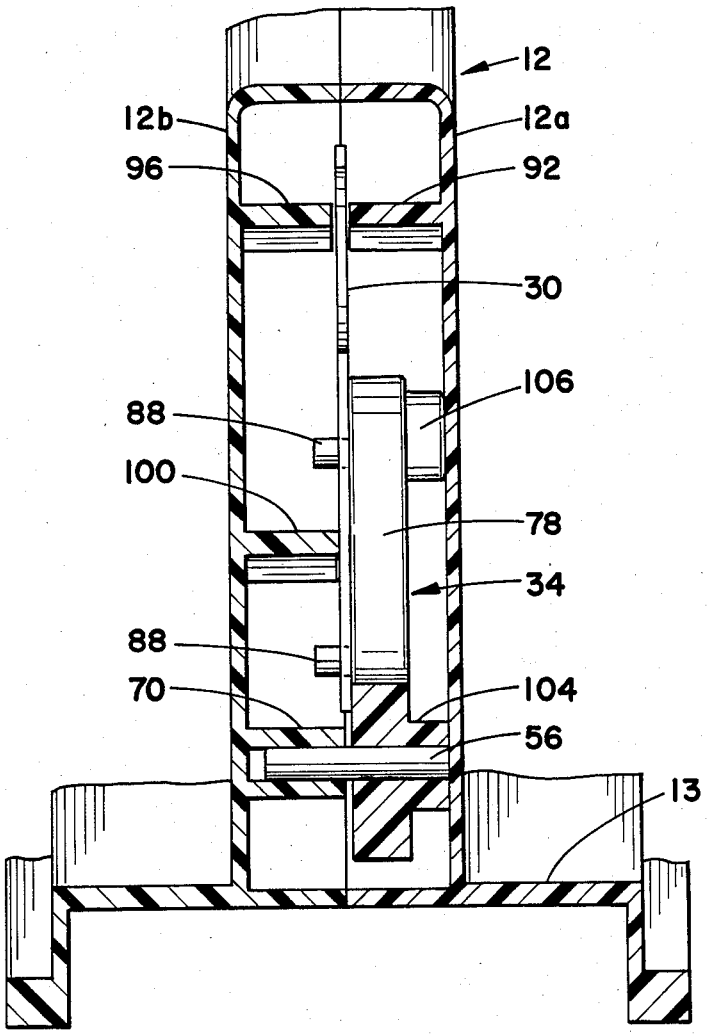
FIG. 6 is a cross-sectional view looking in the direction of line 6—6 in FIG. 4, and showing the housing halves assembled.

The thin sheet metal threader member components 30 and 32 include mounting portions 30*a* and 32*a* and thread engaging ends 30*b* and 32*b*, respectively. Threader members 30 and 32 are of the same construction except for the vertical width of thread engaging ends 30*b* and 32*b* and which widths are different to facilitate the threading of different sized needles. Threader members 30 and 32 are adapted to be loosely received on pins 88 and 90 respectively provided on legs 78 and 80 of lever actuators 34 and 36, and it will be appreciated that mounting ends 30*a* and 32*a* of the threader members are provided with pairs of openings for this purpose. Actuator levers 34 and 36 are laterally captured between housing halves 12*a* and 12*b* and are positioned by component parts thereof to align the corresponding needle threader member with the openings 42 and 48 in the needle supports. Moreover, such lateral capturing provides lateral support for the needle threader members against displacement from pins 88 and 90 and for guidance for the needle threader members during pivotal displacement to achieve a threading operation. More particularly in this respect, and as will be best appreciated from the illustration in FIG. 6 with respect to threader member 30, housing half 12*a* is provided with ribs 92 and 94 respectively underlying the upper end of threader members 30 and 32 for guidance thereof during movement toward the corresponding needle support, and housing half 12*b* is provided with corresponding ribs 96 and 98 which, when the housing halves are interconnected, cooperate with the corresponding one of the ribs 92 and 94 to laterally capture the corresponding threader member therebetween. Further, housing half 12*b* is provided with arcuate ribs 100 and 102 which are respectively disposed between pins 88 and 90 when the housing halves are joined together to laterally capture the threader members against the corresponding actuator leg. Lateral positioning of the lever actuators 34 and 36 is provided on the inner sides thereof by ribs 100 and 102 and by abutment of the inner sides thereof against the corresponding one of the posts 70 and 72. As shown in FIG. 6 with respect to lever actuator 34, lateral positioning is achieved on the outer sides of the actuators by providing the outer side thereof with a hub 104 and a projection 106, each of which slidably engages the housing wall.

From the foregoing description, it will be appreciated that assembly of the needle threading device described hereinabove is simply and quickly achieved by mounting actuator levers 34 and 36 on projections 56 and 58 of housing half 12*a* and positioning the biasing arms thereof beneath projection 86, positioning threader members 30 and 32 over pins 88 and 90 on the corresponding actuator lever, joining the two housing halves by interengaging the mating projections and apertured posts, and positioning the split retaining rings about the upper ends of the needle supports. Such assembly of the component parts is by hand and can be achieved in less than thirty seconds. If a more permanent connection is desired between the housing halves, a suitable adhesive can be applied between the interengaging projections and recesses. Of further advantage is the fact that the housing halves, actuator levers and split retaining rings can be readily molded from plastic material and this, together with the fact that the actuator levers are of one-piece construction further lends to the economy of production achieved by the simple assembly procedure.

While considerable emphasis has been placed herein on the preferred embodiment illustrated and described, it will be appreciated that other embodiments of the invention can be made and that modifications can be made in the preferred embodiment without departing from the principles of the present invention. In this respect, for example, it will be appreciated that the function of a thread release path such as that provided by slot 44 in the preferred embodiment is independent of the structure and motion characteristic of the needle threader member by which threading is achieved. Thus, in accordance with this aspect of the invention, the structure and operation of the needle threader could provide for linear displacement thereof as opposed to the preferred pivotal displacement described herein. Further, in accordance with this aspect of the invention, it will be appreciated that the thread path need not lead directly upwardly along the needle support from the opening therein through which the thread is pushed during a needle threading operation but, for example, could open into a side of the latter opening and thence upwardly along the needle support. With regard to the one-piece pivotal actuator levers, it will be appreciated that the actuating arm extending outwardly of the housing and by which the lever is pivoted could be located relative to the pivot axis of the lever actuator other than at the location shown, as could the biasing arm of the actuator lever. In this respect, it is only important in accordance with this aspect of the invention that the actuator lever be of one-piece construction providing a leg for supporting the threader member, an arm for imparting pivotal movement to the threader member, and an arm for biasing the threader member in one of the directions of pivotal movement. Accordingly, it is to be distinctly understood that the foregoing descriptive matter is to be interpreted merely as illustrative of the present invention and not as a limitation.

Having thus described the invention, What I claim is:

1. A needle threading device comprising housing means supporting upwardly extending needle support means having an upper end and providing needle receiving cavity means having a lower end, said needle support means having a diametrically opposed pair of openings therethrough adjacent said lower end of said cavity means, needle threader means supported in said housing means for displacement in a threading direction to move a thread sequentially through one of said openings, the eye of a needle in said cavity means and thence through the other of said openings, said needle support means including means providing a thread release passageway extending therethrough from said upper end to said one opening, said needle threader means including an actuator lever supported in said housing means for pivotal movement about a fixed axis, threader member means on said actuator lever for pivotal movement therewith, pivotal movement of said actuator lever in one direction relative to said fixed axis displacing said threader member means in said threading direction, said actuator lever including actuating arm means integral therewith and extending outwardly from said housing for pivoting said actuator lever in said one direction, said actuator lever further including biasing means integral therewith and biasing said lever to pivot relative to said fixed axis in the direction opposite said one direction, said actuator lever being of inverted generally T-shaped configuration and including an upwardly extending leg portion carrying said threader member means and having a lower end, and arm portions extending in opposite directions from said lower end of said leg portion, said fixed axis being through said lower end of said leg portion, one of said arm portions extending outwardly from said housing means and providing said actuating arm means, and the other of said arm portions being flexible relative to said leg portion and having an end spaced from said axis and engaging an abutment in said housing means to provide said biasing means for said actuator lever.

2. A needle threading device according to claim 1, wherein said means providing a thread release passageway is a slot extending vertically between said upper end and said one opening.

3. A needle threading device according to claim 1, wherein said threader member means is separable from said leg portion, and means in said housing means engaging said threader member means against separation from said leg portion.

4. A needle threading device according to claim 1, wherein said housing means includes first and second housing halves joined together by a plurality of projections on said first half interengaging corresponding recesses in said second half, said actuator lever means being supported for pivotal movement about said fixed axis by one of said plurality of projections on said first half.

5. A needle threading device according to claim 4, wherein said threader member means is separable from said leg portion, and means in said housing means engaging said threader member means against separation from said leg portion.

6. A needle threading device according to claim 5, wherein said abutment is an abutment pin on said first housing half engaged by said end of said other of said arm portions.

7. A needle threading device according to claim 6, wherein said means in said housing means engaging said threader member means includes ribs on each said first and second housing halves engaging opposite sides of said member means.

* * * * *